United States Patent [19]

Lacey

[11] 4,145,785

[45] Mar. 27, 1979

[54] METHOD AND APPARATUS FOR ATTACHING SOLES HAVING PORTIONS PROJECTING HEIGHTWISE

[75] Inventor: Maurice L. Lacey, Rawtenstall, England

[73] Assignee: USM Corporation, Farmington, Conn.

[21] Appl. No.: 885,081

[22] Filed: Mar. 9, 1978

[30] Foreign Application Priority Data

Jul. 1, 1977 [GB] United Kingdom ..... 27546/77

[51] Int. Cl.[2] ..... A43D 9/00; A43D 89/00

[52] U.S. Cl. ..... 12/142 RS; 12/38

[58] Field of Search ..... 12/33, 33.6, 38, 142 RS

[56] References Cited

U.S. PATENT DOCUMENTS

| | | | |
|---|---|---|---|
| 2,005,621 | 6/1935 | Habicht | 12/33 |
| 2,611,143 | 9/1952 | Gulbrandsen | 12/38 |
| 2,795,822 | 6/1957 | Long | 12/142 RS |
| 2,847,687 | 8/1958 | Germany | 12/38 |

*Primary Examiner*—Patrick D. Lawson

*Attorney, Agent, or Firm*—Carl E. Johnson; Richard B. Megley; Vincent A. White

[57] ABSTRACT

A method and means are disclosed for use in a press whereby a sole and an upwardly projecting portion thereof, for instance, such as is used in many athletic type shoes, are attached adhesively to a shoe. An elastically deformable pad mounted in a relatively rigid support is recessed closely to fit the sole therein and has a wall overlying the projecting portion of the sole, the pad also having walls sloping toward the tread surface of the sole and inwardly of the pad. Sloping surfaces of the support engage external walls of the pad positioned thereon so that, when the support and pad are assembled in the press and the latter operated to cause the shoe to deform the pad, the heightwise projecting portion of the sole will be pressed against the upper of the shoe.

4 Claims, 2 Drawing Figures

METHOD AND APPARATUS FOR ATTACHING SOLES HAVING PORTIONS PROJECTING HEIGHTWISE

BACKGROUND OF THE INVENTION

This invention is concerned with improvements in or relating to the manufacture of shoes and is especially concerned with apparatus for and methods of attaching a sole to a shoe where the sole comprise an upwardly projecting portion intended to be stuck by means of adhesive to a portion of the upper of the shoe.

The word "shoe" where used herein is to understood as referring to footwear generally whether complete or in the course of manufacture.

In the shoe industry, the sole of a shoe is frequently secured thereto by means of adhesive. When this is done, the sole and the shoe are forced together in a sole-attaching press to allow the adhesive to form a strong bond. The sole is usually engaged by a pad or pads profiled to the shape of the sole and is pressed against the shoe bottom while the shoe is held against movement. The profiled pad or pads ensure that a substantially uniform pressure is applied throughout the tread area of the sole so that a substantially uniform bond is achieved throughout this area.

Where the sole to be attached engages only the bottom of the shoe to which it is to be attached, the present methods of attachment are generally satisfactory. However, certain kinds of shoe have soles with an "upwardly" projecting portion (i.e., a portion extending heightwise of the shoe and away from the tread surface of its sole) intended to be stuck to the upper of the shoe, and these create attachment problems because of the lack of pressure available for pressing this portion against the upper. An example of a shoe which has a sole with such an upwardly projecting portion is an athletic shoe where this portion provides a grip surface around the toe of the shoe.

SUMMARY OF THE INVENTION

It is an object of the present invention to provide an improved apparatus by the use of which a sole having an upwardly projecting portion can be satisfactorily attached to a shoe.

It is a further object of the present invention to provide an improved method of attaching soles which have an upwardly projecting portion to shoes.

An apparatus suitable for use in attaching a sole to a shoe where the sole comprises an upwardly projecting portion intended to be stuck by means of adhesive to a portion of the upper of the shoe is hereinafter described in detail to illustrate the invention by way of example. The method of use of the illustrative apparatus is illustrative of the invention in its method aspects.

The illustrative apparatus comprises an elastically deformable pad made, for instance, of polyurethane. By the term "elastically deformable" is meant that the pad will deform under pressure and, when deformed, will apply pressure itself in attempting to return to its undeformed state. The pad has a recess in an upper surface thereof which is shaped to fit closely around a sole positioned therein and which has a wall portion which overlies the upwardly projecting portion of a sole positioned in the recess. The pad has external walls which slope downwardly and inwardly of the pad at an angle varying from about 14° to about 25° around the pad.

The illustrative apparatus also comprises a support for the elastically deformable pad which is made of aluminum and has substantially non-deformable sloping surfaces arranged so that, when the pad is positioned on the support, the sloping surfaces engage the external walls of the pad. By the term "substantially non-deformable" is meant that the surfaces will resist being deformed to an extent such that interaction of the surfaces and the external walls of the pad will cause the pad to be deformed rather than the surfaces. The support is essentially in the form of a box wherein the pad is received.

In the illustrative method, with the support mounted on a sole-attaching press, a sole and a shoe are positioned in engagement with a layer of adhesive therebetween, the sole is positioned in the recess of the elastically deformable pad, and the pad is positioned on the support. The sole-attaching press is operated to press the shoe downwardly into the pad causing the pad to deform, through the interaction of the sloping surfaces of the support and the external walls of the pad where a wedging action takes place. The deformation of the pad causes the pad to press the upwardly projecting portion of the sole against the upper of the shoe so that the portion sticks to the upper.

The present invention provides, in one of its aspects, an apparatus suitable for use in attaching a sole having a tread surface to a shoe where the sole comprises a portion projecting heightwise of the shoe and away from its tread surface and intended to be stuck by means of adhesive to a portion of an upper of the shoe, the apparatus comprising an elastically deformable pad having a recess in a surface thereof, the recess being shaped to fit closely around the sole positioned therein and having a wall portion which overlies the heightwise projecting portion of the sole so positioned, the pad also having external walls which slope toward the tread surface and inwardly of the pad, and a support for the pad comprising substantially non-deformable sloping surfaces disposed so that, when the pad is positioned on the support, the sloping surfaces of the support engage the external walls of the pad, the arrangement being such that, when the support is mounted with the pad positioned thereon on a sole-attaching press, a sole positioned in the recess of the pad, and a shoe positioned on the sole, operation of the sole-attaching press to press the shoe downwardly into the pad causes the pad to deform, through the interaction of the sloping surfaces of the support and the external walls of the pad, thereby pressing the heightwise projecting portion of the sole against the upper of the shoe.

The present invention provides, in another of its aspects, a method of attaching a sole to a last-mounted shoe where the sole comprises an upwardly projecting portion intended to be stuck by means of adhesive to a portion of the upper of the shoe, the method comprising positioning the sole and the shoe in engagement with a layer of adhesive therebetween, positioning the sole in a recess in an elastically deformable pad, the recess being in an upper surface of the pad and so shaped that the pad fits closely around the sole and overlies the upwardly projecting portion of the sole, the pad also comprising external walls which slope downwardly and inwardly of the pad, positioning the pad on a support which comprises substantially non-deformable sloping surfaces which engage the external walls of the pad, and operating a sole-attaching press to press the last-mounted shoe relatively downwardly into the pad causing the pad to deform, through the interaction of the sloping surfaces of the support and the external walls of the pad, thereby causing the pad to press the upwardly projecting portion of the sole against the upper of the shoe.

The above and other of the various objects and several aspects of the invention will become more clear from the following detailed descriptions, to be read with reference to the accompanying drawings, of the illustrative apparatus and method of sole attaching aforementioned. It is to be understood that the illustrative apparatus and the illustrative method have been selected for description by way of example and not of limitation of the invention.

DESCRIPTION OF THE PREFERRED EMBODIMENT

Figure 1:
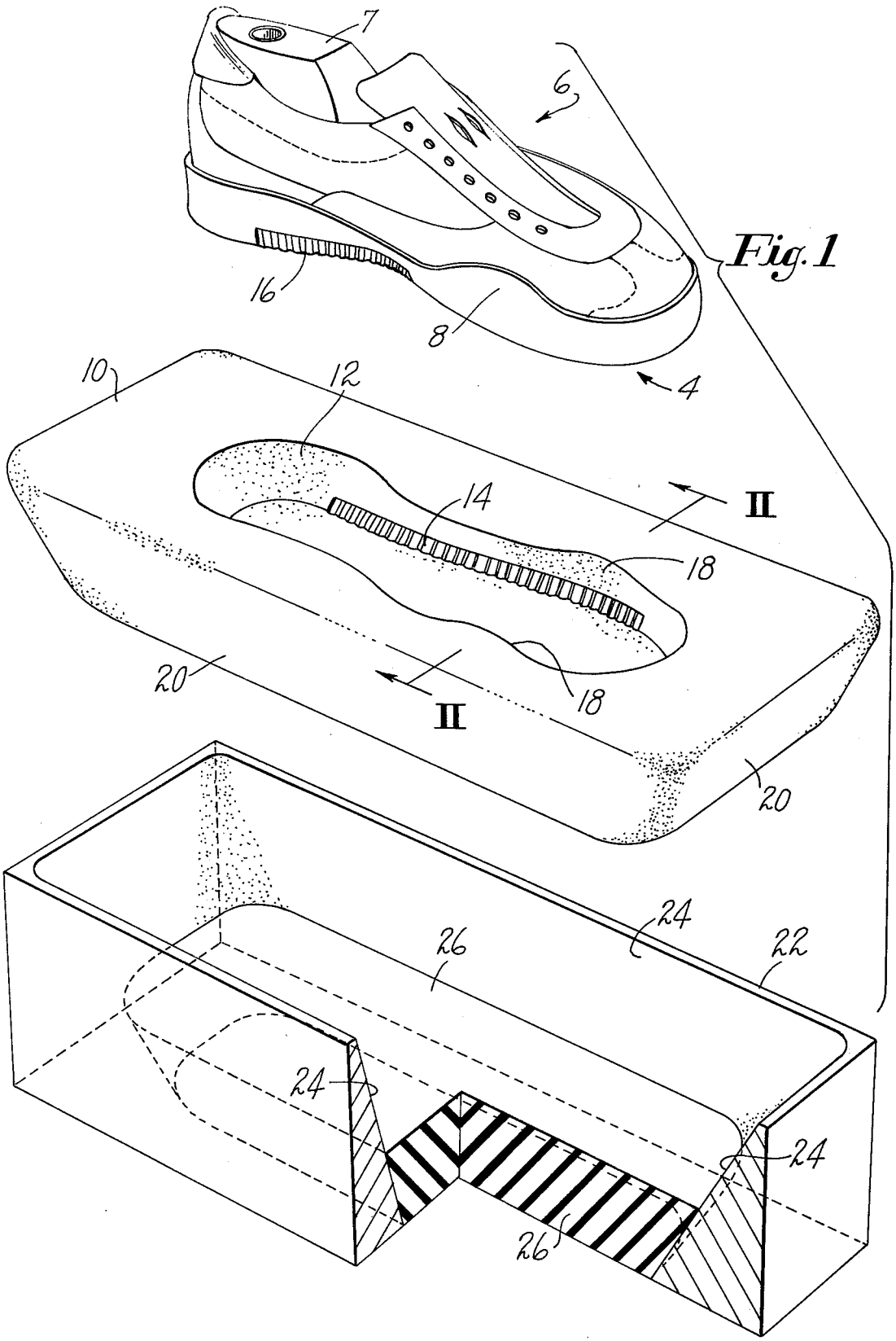
FIG. 1 is an exploded perspective view of the illustrative apparatus and a shoe with a sole to be attached thereto, some parts of the illustrative apparatus have been broken away to show the construction.

The illustrative apparatus is suitable for use in attaching a sole 4 to an athletic shoe 6 mounted on a last 7. The sole 4 comprises an upwardly projecting portion 8 intended to be stuck by means of adhesive to a portion of the upper of the shoe 6 extending around the toe of the shoe 6.

The illustrative apparatus comprises an elastically deformable pad 10, preferably made, for instance, of a commercially available polyurethane. The pad 10 has a recess 12 in an upper surface thereof which recess is shaped to fit closely around the sole 4 when the sole 4 is positioned in the recess 12. The recess 12 is shaped to fit closely not only around the sides of the sole 4 but also across the bottom of the sole 4. The wall of the recess 12 is ribbed at 14 so as to be complementary to ribbing, such as that shown at 16, on the sole 4. The recess 12 also has a wall portion 18 which overlies the upwardly projecting portion 8 of the sole 4.

The pad 10 has external side walls 20 which slope downwardly and inwardly of the pad 10. Along the sides of the pad 10 the angle of slope of the walls 20 is approximately 14° from the vertical and at the ends of the pad 10 the slope is approximately 25°. However, while any suitable angle of slope is acceptable, the range from about 10° to about 25° has been found to be particularly suitable.

The illustrative apparatus also comprises a support 22 for the pad 10. The support 22 is in the form of a box and the pad 10 is positioned on the support 22 by being received into the box with its external side walls 20 engaging internal sloping surfaces 24 of the support 22. The surfaces 24 are substantially non-deformable, since the support 22 is commonly made of aluminum, and have slopes which correspond to those of the walls 20 of the pad 10 so that, when the pad 10 is positioned on the support 22, substantially all of the walls 20 are engaged by the surfaces 24.

The illustrative apparatus also comprises ejecting means in the form of a resilient pad 26 positioned in the box formed by the support 22 and operable to eject the pad 10 from the support 22. The pad 26 is positioned beneath the pad 10 and is arranged to be compressed when downward sole attaching pressure is applied to the shoe 6 positioned on the pad 10 and, upon release of such pressure, to urge the pad 10 upwardly for removal.

The illustrative apparatus is used in the illustrative method of sole attaching which will now be described. In the illustrative method, the sole 4 and the last-mounted shoe 6 are positioned in engagement with one another with a layer of adhesive therebetween. The sole 4 and the shoe 6 are positioned in the relationship in which they will be in the finished shoe with the portion 8 overlying the portion of the upper of the shoe 6 to which it is to be stuck. After the sole 4 and the shoe 6 have been positioned in engagement with one another, the sole 4 is positioned in the recess 12. The pad 10 then fits closely around the sole 4 and overlies the upwardly projecting portion 8 of the sole 4.

Next in the illustrative method, the pad 10 is positioned on the support 22 which has previously been mounted on a sole attaching press (not shown). The walls 20 of the pad 10 are now in engagement with the surfaces 24 of the support 22. The pad 10 rests on top of the resilient pad 26. At this point in the illustrative method, the support 22 is mounted on the sole-attaching press with the pad 10 positioned thereon, the sole 4 is positioned in the recess 12, and the shoe 6 is positioned on the sole 4.

Figure 2:
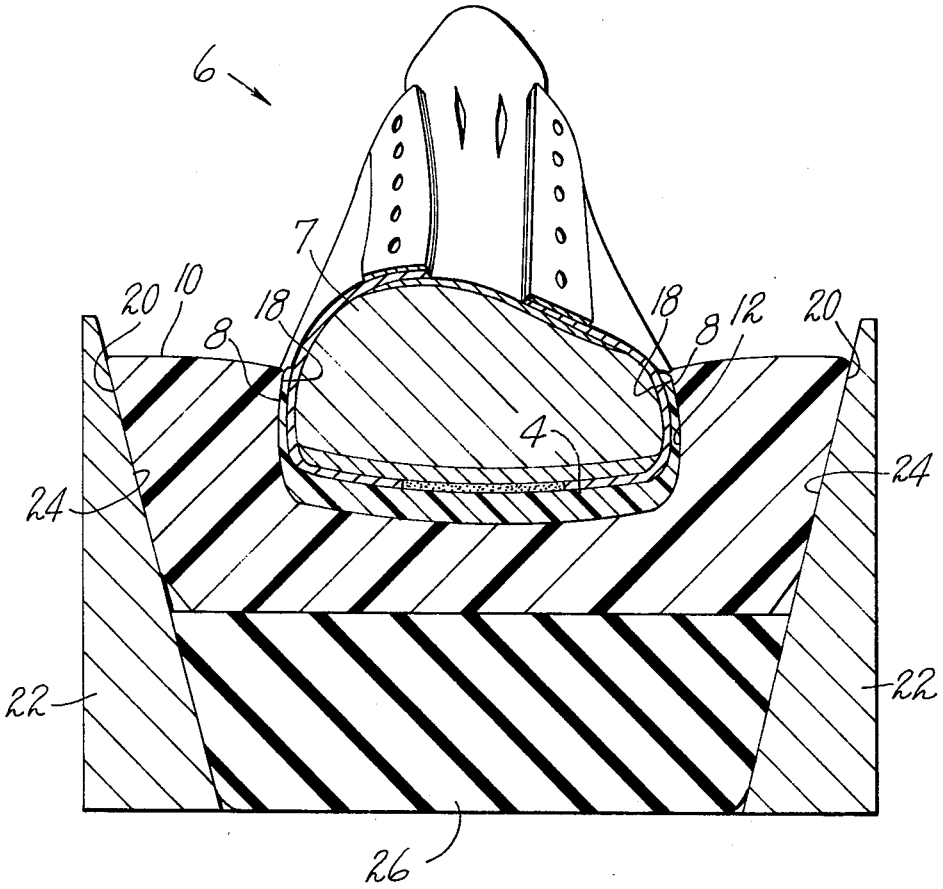
FIG. 2 is a sectional view taken through the illustrative apparatus at the region indicated by the line II—II in FIG. 1.

Next in the illustrative method, the sole-attaching press is operated to press the shoe 6 downwardly into the pad 10. This causes the pad 10 to deform, through the interaction of the surfaces 24 and the walls 20 where a wedging action takes place pressing the pad 10 inwardly against the shoe 6 thereby pressing the upwardly projecting portion 8 against the upper of the shoe (see FIG. 2). As the sole-attaching press is operated, the resilient pad 26 is compressed.

After a suitable time interval, the pressure applied by the sole-attaching press is released whereupon the pad 26 recovers urging the pad 10 upwardly and ejecting it either wholly or partially from the support 22. The last-mounted shoe 6 can now be removed, the sole 4 including the portion 8 having been stuck to it.

In modifications of the illustrative apparatus, the pad 26 may be replaced by a system of compression springs or by a handle integral with the pad 10 by which an operator can eject the pad 10 from the support 22. Furthermore, the pad 10 may be made of an suitable elastically deformable material although such material should preferably be readily mouldable so that the recess 12 can be moulded to shape to the sole. The support 22 may also be made of other suitable materials, for example epoxy resin.

It is found that by the use of the illustrative apparatus and illustrative method soles which comprise an upwardly projecting portion, such as at 8 for example, can be satisfactorily attached throughout adhesivized surfaces.

Having thus described my invention, what I claim as new and desire to secure as Letters Patent of the United States is:

1. Apparatus for use in a press for attaching a sole having a tread surface to a shoe where the sole comprises a portion projecting heightwise of the shoe and away from its tread surface and intended to be adhesively secured to a portion of an upper of the shoe, the apparatus comprising an elastically deformable pad and a support for the pad, the pad having a recess shaped to fit closely around the sole positioned therein and having a wall portion of the recess which overlies the heightwise projecting portion of the positioned sole, the pad further having external walls sloping inwardly thereof toward the tread surface, said support comprising substantially non-deformable sloping surfaces disposed so that, when the support is mounted with the pad positioned thereon in the attaching press and the shoe is positioned on the sole in the pad recess, operation of the press to urge the shoe to deform the pad will, by interaction of the sloping surfaces of the support and the external walls of the pad, press the heightwise projecting portion of the sole against the upper of the shoe.

2. Apparatus as in claim 1 wherein the external walls of the pad slope toward said tread surface and inwardly of the pad at an angle varying from about 14° to about 25° around the pad.

3. Apparatus as in claim 1 wherein the wall of the pad recess is at least partly formed with ribs.

4. A method of attaching a sole to a last-mounted shoe where the sole comprises an upwardly projecting portion intended to be stuck by adhesive to a portion of the upper of the shoe, the method comprising:

a. positioning of the sole and the shoe in engagement with a layer of adhesive therebetween , b. positioning the sole in a recess in the upper surface of an elastically deformable pad, the recess closely accommodating the sole and overlying the upwardly projecting portion thereof, and said pad comprising external walls sloping downwardly and inwardly of the pad, c. positioning the pad on a support comprising substantially non-deformable sloping surfaces which engage the external walls of the pad, d. and operating a sole-attaching press to press the last-mounted shoe relatively downwardly into the pad causing the pad to deform, through interaction of the sloping surfaces of the support and the external walls of the pad, thus causing the pad to press the upwardly projecting portion of the sole against the upper of the shoe.

* * * * *